US005626191A

United States Patent [19]

Greaves et al.

[11] Patent Number: 5,626,191

[45] Date of Patent: May 6, 1997

[54] OILFIELD IN-SITU COMBUSTION PROCESS

[75] Inventors: Malcolm Greaves, Avon, United Kingdom; Alexandru T. Turta, Calgary, Canada

[73] Assignee: Petroleum Recovery Institute, Calgary, Canada

[21] Appl. No.: 494,300

[22] Filed: Jun. 23, 1995

[51] Int. Cl.[6] ..... E21B 43/24; E21B 43/243; E21B 43/30

[52] U.S. Cl. ..... 166/245; 166/50; 166/261; 166/263

[58] Field of Search ..... 166/50, 245, 256, 166/261, 263, 272

[56] References Cited

U.S. PATENT DOCUMENTS

| | | | |
|---|---|---|---|
| 3,017,168 | 1/1962 | Carr | 166/256 X |
| 3,150,715 | 9/1964 | Dietz | 166/263 X |
| 4,384,613 | 5/1983 | Owen et al. | 166/256 |
| 4,390,067 | 6/1983 | Willman | 166/50 X |
| 4,460,044 | 7/1984 | Porter | 166/50 X |
| 4,598,770 | 7/1986 | Shu et al. | 166/50 X |
| 4,682,652 | 7/1987 | Huang et al. | 166/50 X |
| 4,706,751 | 11/1987 | Gondouin | 166/50 X |
| 5,211,230 | 5/1993 | Ostapovich et al. | 166/245 |
| 5,339,897 | 8/1994 | Leaute | 166/245 |
| 5,456,315 | 10/1995 | Kisman et al. | 166/50 X |

*Primary Examiner*—George A. Suchfield
*Attorney, Agent, or Firm*—Sheridan Ross P.C.

[57] ABSTRACT

A well arrangement is used wherein the production wells are generally horizontal, positioned low in the reservoir and arranged generally perpendicularly to a laterally extending combustion front. The combustion front is propagated by a row of vertical air injection wells completed high in the reservoir. The open production wells function to cause the combustion front to advance along their lengths. The process is characterized by a generally upright combustion front having good vertical and lateral sweep.

7 Claims, 14 Drawing Sheets

VOLUME SWEPT BY THE COMBUSTION FRONT
ALONG THE HORIZONTAL MIDPLANE (Time = 930min.)

VOLUME SWEPT BY THE COMBUSTION FRONT
ALONG THE VERTICAL MIDPLANE (Time = 930 min.)

VOLUME SWEPT BY THE COMBUSTION FRONT ALONG THE HORIZONTAL MIDPLANE (Time = 999 min.)

VOLUME SWEPT BY THE COMBUSTION FRONT ALONG THE VERTICAL MIDPLANE (Time = 999 min.)

HORIZONTAL TEMPERATURE PROFILES AT TOP LAYER 45 MINUTES AFTER IGNITION

HORIZONTAL TEMPERATURE PROFILES AT BOTTOM LAYER 45 MINUTES AFTER IGNITION

VERTICAL TEMPERATURE PROFILES ALONG CENTRAL AXIS OF CELL AFTER 45 MINUTES

VERTICAL TEMPERATURE PROFILES ALONG CENTRAL AXIS OF CELL AFTER 240 MINUTES

VERTICAL TEMPERATURE PROFILES ALONG CENTRAL AXIS OF CELL AFTER 360 MINUTES

VERTICAL TEMPERATURE PROFILES ALONG CENTRAL AXIS OF CELL AFTER 460 MINUTES

Fig 14A UPSTRUCTURE FAULT
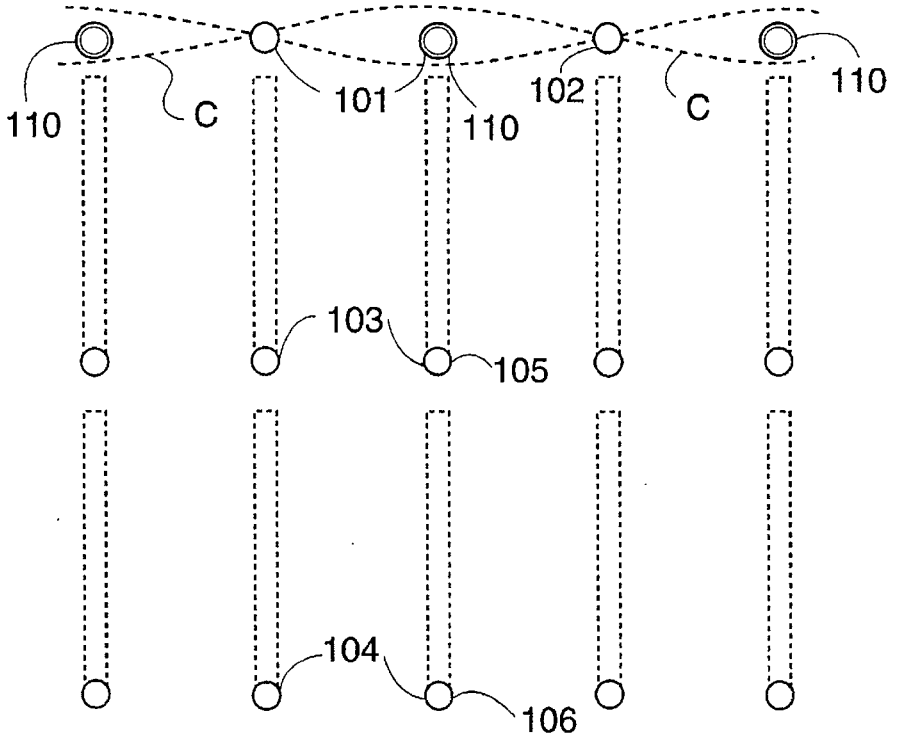
Fig. 14B UPSTRUCTURE FAULT
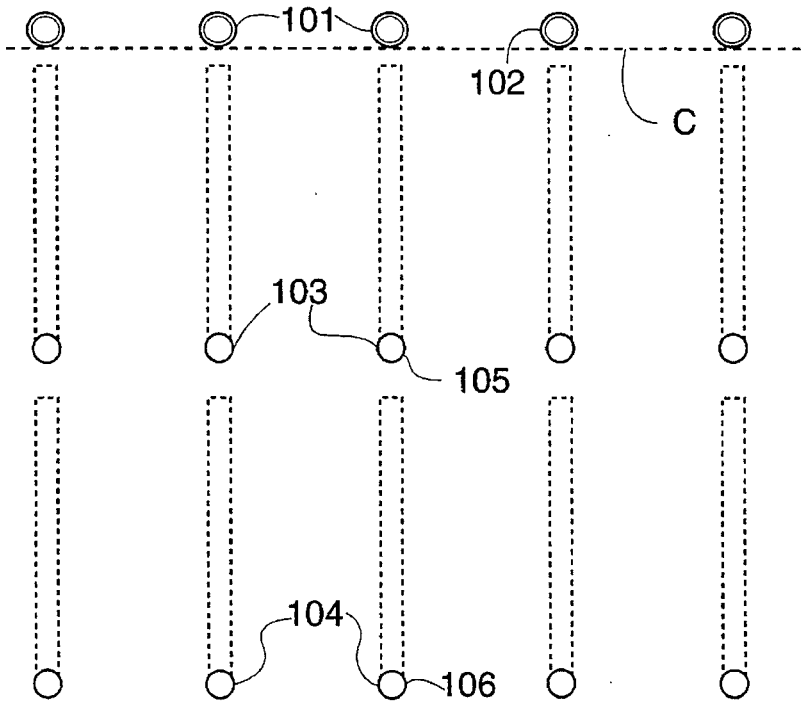

OILFIELD IN-SITU COMBUSTION PROCESS

TECHNICAL FIELD

This invention relates to an in-situ combustion process for recovering hydrocarbons from an underground reservoir. More particularly, it relates to a process in which the production wells each have a horizontal leg and these legs are positioned perpendicularly to and in the path of a laterally extending and advancing combustion front.

BACKGROUND ART

In-situ combustion processes are applied for the purpose of heating heavy oil, to mobilize it and drive it to an open production well for recovery.

In general, the usual technique used involves providing spaced apart vertical injection and production wells completed in a reservoir. Typically, an injection well will be located within a pattern of surrounding production wells. Air is injected into the formation, the mixture of air and hydrocarbons is ignited, a combustion front is generated in the formation and this resulting combustion front is advanced outwardly toward the production wells. Or alternatively, a row of injection wells may feed air to a laterally extending combustion front which advances as a line drive toward a parallel row of production wells.

In both cases, the operator seeks to establish an upright combustion front which provides good vertical sweep and advances generally horizontally through the reservoir with good lateral sweep.

However, the processes are not easy to operate and are characterized by various difficulties.

One such difficulty arises from what is referred to as gravity segregation. The hot combustion gases tend to rise into the upper reaches of the reservoir. Being highly mobile, they tend to penetrate permeable streaks and rapidly advance preferentially through them. As a result, they fail to uniformly carry out, over the cross-section of the reservoir, the functions of heating and driving oil toward the production wells. The resulting process volumetric sweep efficiency is therefore often undesirably low. Typically the efficiencies are less than 30%.

It would therefore be desirable to modify the in-situ combustion technique so as to better control the way in which the combustion gases flow and the front advances, so as to increase the volumetric sweep efficiency. The work underlying the present invention was undertaken to reach this objective.

The invention, in its preferred form, incorporates aspects of two processes which are known in the art.

Firstly, it is known to initiate the combustion drive at the high end of a reservoir having dip and propagate the combustion front downstructure, isobath-wise. This procedure to some extent reduces the problem of gravity segregation of the combustion gases, because the gases are forced to displace the oil downward, in a gravity influenced, stable manner.

Secondly, Ostapovich et al, in U.S. Pat. No. 5,211,230, disclose completing a vertical air injection well relatively high in the reservoir and a horizontal production well relatively low in the reservoir. The production well is positioned transversely relative to the combustion front emanating from the injection well. The production well is spaced from the injection well. By implementing this arrangement, the combustion front follows a downward path, toward the low pressure sink provided by the production well and the benefit of gravity drainage of heated oil is obtained. These effects enhance the sweep efficiency of the process and facilitate the heated oil reaching the production well. However, the premature breakthrough of the combustion front at a locus along the length of the transverse, horizontal leg will result in leaving an unswept reservoir zone between the leg's toe and the breakthrough locus.

The present invention will now be described.

SUMMARY OF THE INVENTION

In accordance with the preferred form of the invention, it has been determined that:

- if a generally linear and laterally extending, upright combustion front is established and propagated high in an oil-containing reservoir; and
- if an open production well is provided having a horizontal leg positioned low in the reservoir so that the well extends generally perpendicularly to and lies in the path of the front and has its furthest extremity ("toe") spaced from but adjacent to the injection source; then
- the production well provides a low pressure sink and outlet that functions to induce the front to advance in a guided and controlled fashion, first towards the toe and then along the length of the horizontal leg—under these circumstances, the front has been found to remain generally stable and upright and is characterized by a relatively high sweep efficiency;
- additionally, the air flows through the burnt out reservoir and through the upright combustion front, forming combustion gases ($CO_2$, CO, $H_2O$) whose streamlines bend towards the horizontal leg, due to the downward flow gradient created by the action of the production well as a sink. An oil upgrading zone is formed immediately ahead of the front. The draining oil tends to keep the bore of the horizontal leg full, so there is little opportunity for unused oxygen to be produced through the production well until the front has advanced the length of the leg; and
- as just stated, the heated oil drains readily into the production well for production therethrough.

When compared in experimental runs with a conventional procedure wherein spaced apart, simulated vertical air injection and production wells were completed in the same horizontal plane of the reservoir and a combustion front was initiated and propagated, the present invention was found to be relatively characterized by:

- increased percentage of reservoir volume swept,
- increased recovery percentage of the oil in place, and
- increased average gravity of produced oil.

Additionally, the present procedure involving a horizontal producer, is found to be characterized by the advantage that the combustion front always intercepts the horizontal leg of the horizontal well at the toe point, rather than at a location along the length of the leg.

Up to this point, the invention has been described with reference only to a combustion process. As previously stated, an important feature of the invention is that the properly oriented, open horizontal leg of the production well functions to directionally guide and stabilize the advancing displacement front. There is a likelihood that this feature could beneficially be used with a steam, partially miscible gas drive or miscible solvent gas drive to control and stabilize the advancing displacement front which is functioning to reduce the viscosity of the oil directly in front of it.

Therefore, in broad terms, the invention is a process for reducing the viscosity of oil in an underground reservoir and driving it to a production well for recovery, comprising: providing a well, completed relatively high in the reservoir, for injecting a gaseous fluid into the reservoir to form an advancing, laterally extending displacement front operative to reduce the viscosity of reservoir oil; providing at least one open production well having a horizontal leg completed relatively low in the reservoir and positioned substantially perpendicular to and in the path of the advancing front; injecting the fluid through the well and advancing the displacement front along the leg; and producing the production well to recover oil from the reservoir.

DESCRIPTION OF THE DRAWINGS

FIGS. 14*a*, 14*b*, 14*c*, 14*d*, 14*e* and 14*f* illustrate various phases of the combustion process according to the layout shown in FIGS. 11 and 12.

BEST MODE OF THE INVENTION

Figure 1A:
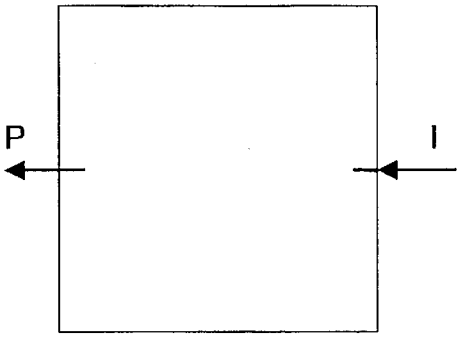
FIGS. 1*a* and 1*b* are top plan and side views schematically showing a sand pack with simulated injection and production wells completed in a common horizontal plane, as was the case in experimental run 1-D reported on below.

The invention was developed in the course of carrying out an experimental investigation involving test runs carried out in a test cell or three dimensional physical model.

More particularly, a test cell 1, shown in FIGS. 5*a*, 5*b*, 5*c* and 6, was provided. The cell comprised a rectangular, closed, thin-walled stainless steel box 2. Dimension-wise, the box 2 formed a chamber 3 having an area of 40 square centimetres and height of 10 centimetres. The thickness of each box wall was 4 millimetres. The chamber 3 was filled with a sand pack 4 consisting of a mixture of sand, oil and water. The composition of the uniform mixture charged into the chamber 3 was:

sand- 83–87 wt. % oil- 11–14 wt. % water- 2–3 wt. %

The porosity of the sand pack 4 was about 30% and the permeability was about 10 darcys.

The loaded cell box 2 was placed inside a larger aluminum box 5 and the space between them was filled with vermiculite powder insulation.

Sixty type K thermocouples 6, positioned at 6 cm intervals as shown in FIGS. 5*a*, 5*b*, 5*c* and 6, extended through the wall of the cell 1 into the sand pack 4, for measuring the three dimensional temperature distribution in the sand pack 4.

To compensate for heat losses, the cell 1 was wound with heating tape (not shown). This heat source was controlled manually, on demand, in response to the observed combustion peak temperature and adjacent wall temperature values. The temperature at the wall of the cell was kept a few degrees ° C. less than the temperature inside the sand, close to the wall. In this way, the quasi-adiabatic character of the run was assured.

A cell heater 7 was embedded in the top section of the sand pack 4 at the air injection end, for raising the temperature in the region of the injection well 8 to ignition temperature.

One or more simulated air injection wells 8 were provided at the injection end of the cell 1. A simulated production well 9 was provided at the opposite or production end of the cell 1.

The positioning and vertical or horizontal disposition of the wells 8, 9 are shown schematically in FIGS. 1*a*, 1*b*, 2*a*, 2*b*, 3, 4*a* and 4*b* for the five test runs reported on below.

Figure 2A:
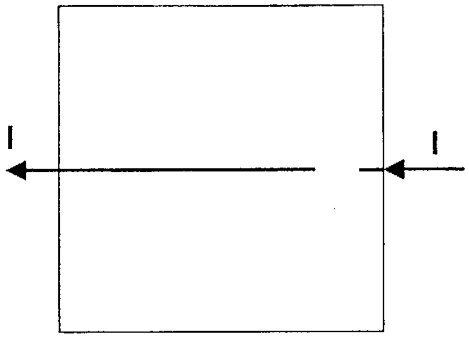
FIGS. 2*a* and 2*b* are top plan and side views schematically showing a sand pack with simulated vertical injection well and perpendicular, horizontal production wells completed high and low in the pack, respectively, as was the case in experimental run 2-D reported on below.
Figure 1B:
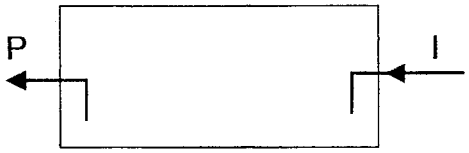
Figure 2B:
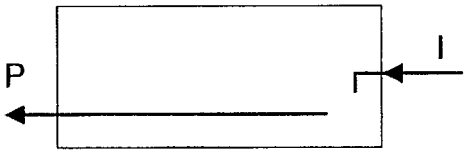
Figure 3:
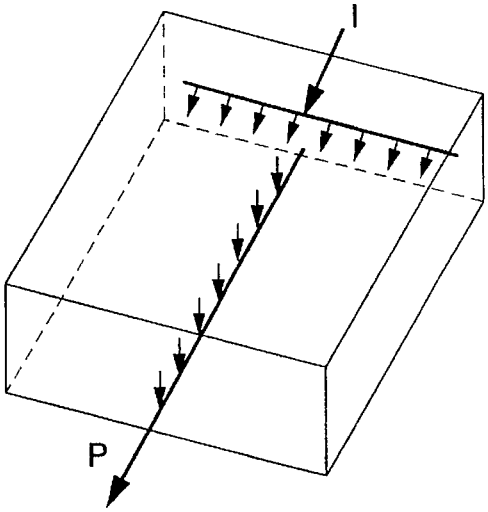
FIG. 3 is a perspective view schematically showing a sand pack with a linear array of simulated injection wells and a simulated perpendicular, horizontal well, completed high and low respectively in the pack, as was the case in experimental runs 3-D and 4-W reported on below.
Figure 4A:
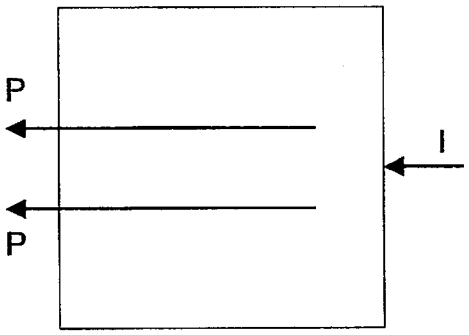
FIGS. 4*a* and 4*b* are top plan and side views schematically showing a staggered arrangement of simulated wells completed in the sand pack with a vertical injection well and a pair of parallel, spaced apart, perpendicular, horizontal wells, completed high and low respectively in the pack, as was the case in experimental run 5-D reported on below.
Figure 4B:
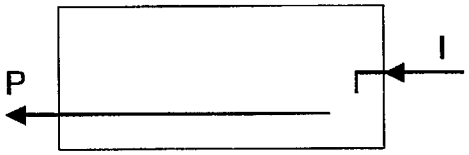
Figure 5A:
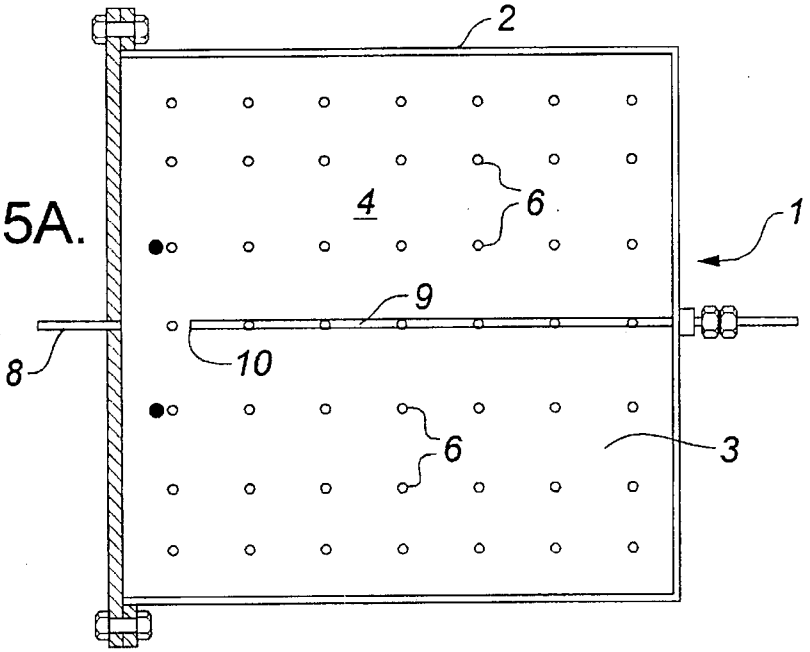
FIGS. 5*a*, 5*b* and 5*c* are top plan, side and end views of a test cell used in the experimental runs reported on below.
Figure 5B:
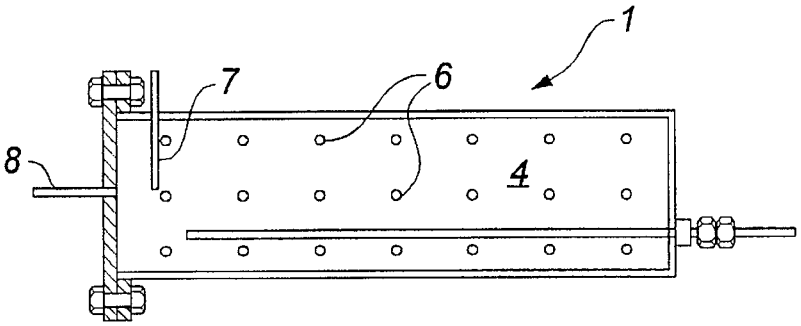
Figure 5C:
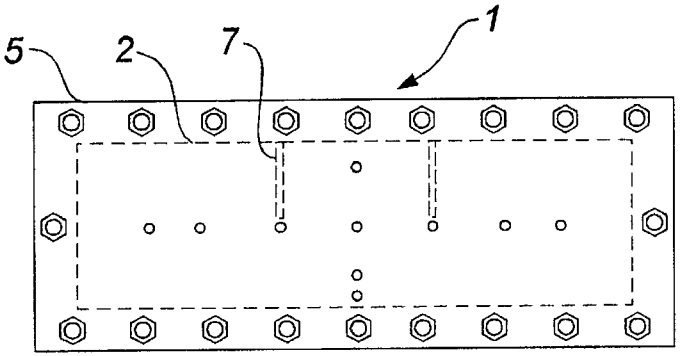

As shown in FIGS. 1*a*, 1*b* for run 1-D, the air injection and production wells 8, 9 were short and coplanar. They were both completed under the horizontal mid-plane of the sand pack 4. This arrangement simulated vertical injection and production wells completed at about the same depth. As shown in FIGS. 2*a*, 2*b* for run 2-D, the air injection well 8 was short and positioned relatively high in the sand pack 4. The production well 9 was horizontal, elongated, positioned low in the sand pack 4 relative to the injection well 8 and positioned with its toe 10 adjacent to but spaced from the injection well. As shown in FIG. 3 for runs 3-D and 4-W, a row 11 of vertical injection wells 8, positioned laterally across the sand pack 4, were provided. The injection wells were located relatively high in the sand pack. The production well 9 was horizontal, elongated, positioned low in the sand pack and had its toe adjacent to but spaced from the injection wells. As shown in FIGS. 4*a*, 4*b* for run 5-D, a single vertical air injection well 8 was provided high in the sand pack 4 and a pair of horizontal production wells 9 were provided low in the pack. The production wells were laterally spaced relative to the injection well, to provide a staggered line drive system.

All of the horizontal production wells 9 were arranged to be generally perpendicular to a laterally extending combustion front developed at the injection source. However, the toe 10 of the production well was spaced horizontally away from a vertical projection of the injection well.

Each of the injection and production wells 8, 9 were formed of perforated stainless steel tubing having a bore 4 mm in diameter. The tubing was covered with 100 gauge wire mesh (not shown) to exclude sand from entering the tubing bore.

Figure 6:
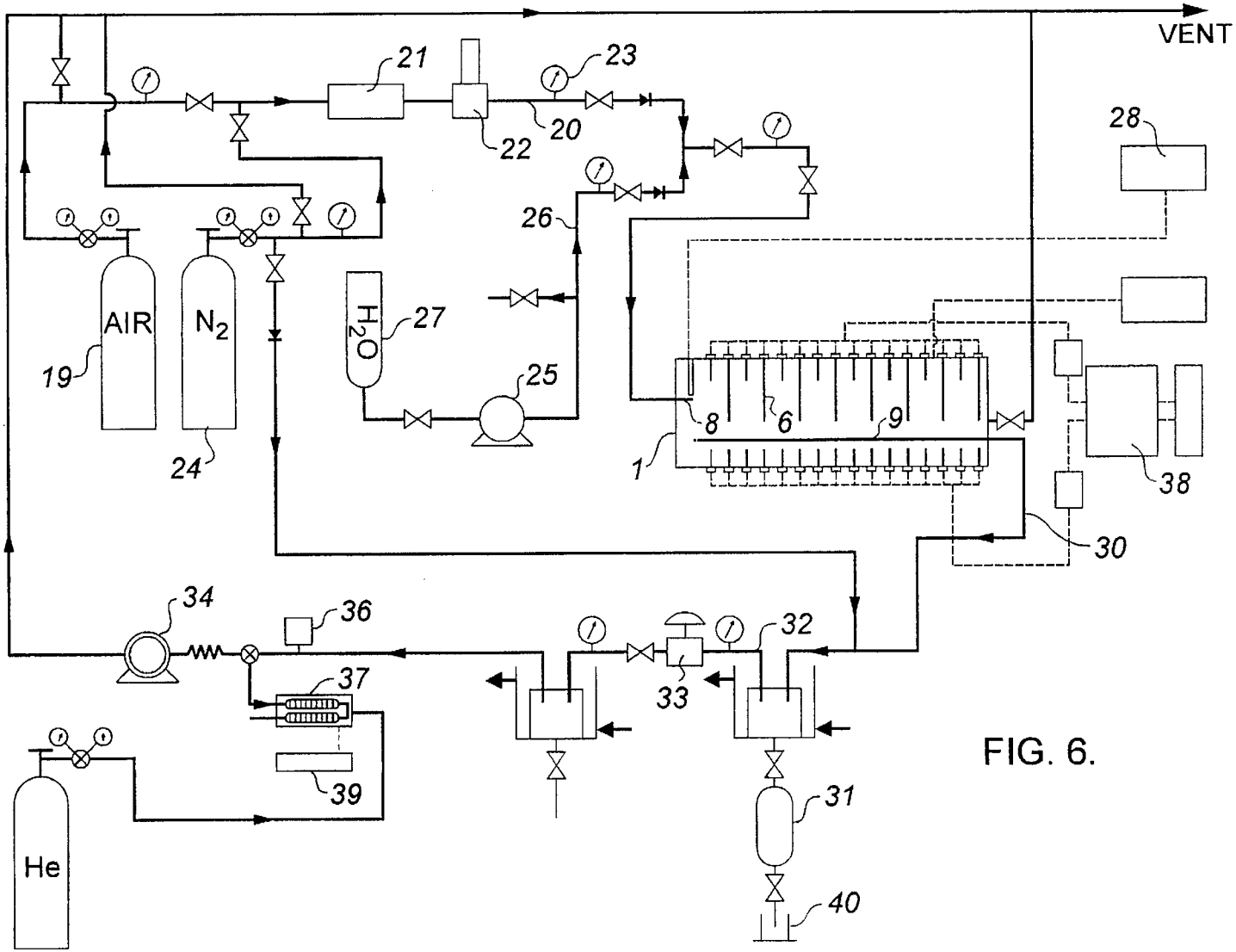
FIG. 6 is a flow diagram showing the laboratory set-up, including the test cell of FIGS. 5*a*–5C, used to conduct the experimental runs reported on below.

The combustion cell 1 was integrated into a conventional laboratory system shown in FIG. 6. The major components of this system are now shortly described.

Air was supplied to the injection well 8 from a tank 19 through a line 20. The line 20 was sequentially connected with a gas dryer 21, mass flowmeter 22 and pressure gauge 23 before reaching the injection well 8. Nitrogen could be supplied to the injection well 8 from a tank 24 connected to line 20. Water could be supplied to the injection well 8 from a tank 27 by a pump 25 through line 26. Line 26 was connected with line 20 downstream of the pressure gauge 23. A temperature controller 28 controlled the ignition heater 7. The produced fluids passed through a line 30 connected with a separator 31. Gases separated from the produced fluid and passed out of the separator 31 through an overhead line 32 controlled by a back pressure regulator 33. The regulator 33 maintained a constant pressure in the test cell 1. The volume of the produced gas was measured by a wet test meter 34 connected to line 32. The liquid leaving the separator was collected in a cylinder 40.

Part of the produced gas was passed through an oxygen analyzer 36 and gas chromatograph 37. Temperature data from the thermocouples 6 was collected by a computer 38 and gas composition data was collected from the analyzer 36 and gas chromatograph 37 by an integrator 39.

Air was injected at a rate of approximately 0.243 $sm^3$/hr. and ignition was initiated using the heater 7. The tests were typically continued for up to 22 hours. In the run where water was added, its rate was approximately 0.43 kg/hr..

Following completion of each run, an analysis of the cell sand pack 4 was undertaken to determine the volumetric sweep efficiency. The analysis comprised a physical removal of successive vertical layers of the sandpack at 3 cm intervals and determining the extent of the burned zone by measuring the oil and coke content. In this way the volumetric sweep of the burning front was determined post-mortem and compared with that obtained from the peak temperature profiles during the run.

The relevant results for the runs are set forth in Table I.

TABLE I

| Run | Configuration | Volume Swept % | Air-Oil Ratio ($SM^3/M^3$ | Average Gravity (°API) Of Produced Oil |
|---|---|---|---|---|
| 1-D | FIG. 1 | 58.7 | 2045 | 14 |
| 2-D | FIG. 2 | 53.0 | 1960 | 19–21 |
| 3-D | FIG. 3 | 66 | — | 19–21 |
| 4-W | FIG. 3 | 77 | 923 | 19–21 |
| 5-D | FIG. 4 | 69.5 | 1554 | 15 |

Legend:
D = dry in situ combustion
W = moderate wet combustion

Figure 7A:
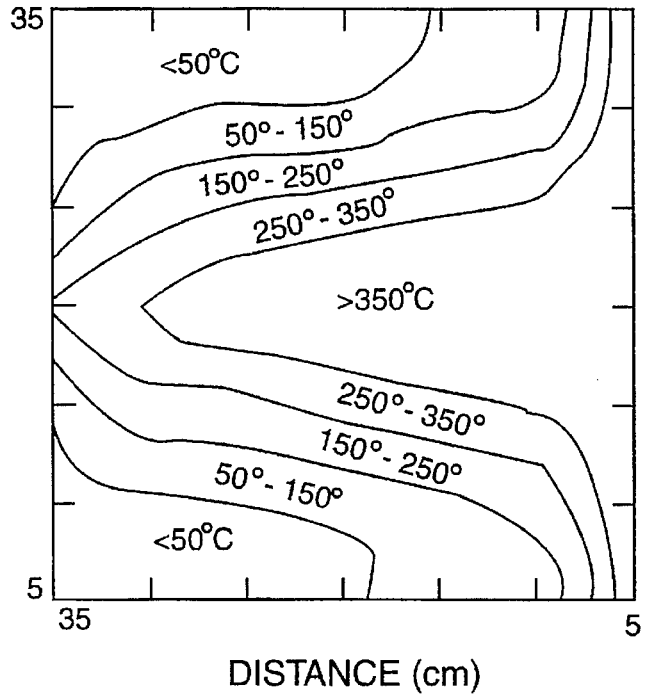
Fig. 7A (PRIOR ART)
FIGS. 7*a* and 7*b* are isotherm maps developed in the sand pack during run 1-D (prior art configuration), taken along the horizontal and vertical mid-planes respectively.
Figure 7B:
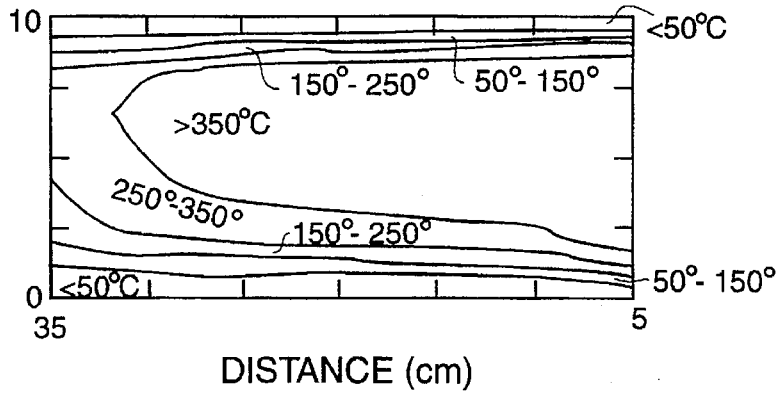
Fig. 7B (PRIOR ART)

FIGS. 7*a* and 7*b* show the isotherm or temperature contour maps developed along the horizontal mid-plane and the central vertical mid-plane, respectively, in the sand pack after 930 minutes of combustion during run 1-D, using the well configuration of FIGS. 1*a* and 1*b*. (This run was carried out using conventional vertical well placement.)

The nature and extent of the volume swept by the combustion front is indicated by the isotherms. It will be noted that, in the plan view of FIG. 7*a*, the combustion front was relatively narrow towards the production well side. Large volumes of oil were left substantially unheated on each side of the sand pack. On the other hand, the central vertical mid-plane isotherms in FIG. 7*b* show that the leading edge of the maximum recorded temperature (>350° C.), in the region closed to the production well, is already located in the upper third of the layer. These results are indicative of gas override.

Figure 8A:
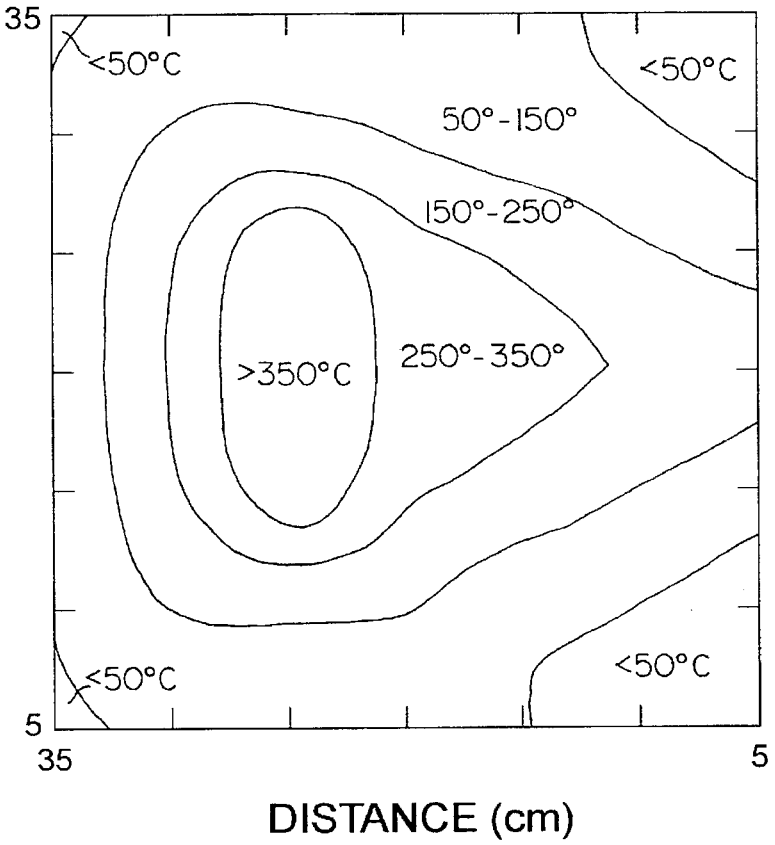
FIGS. 8*a* and 8*b* are the isotherm maps developed in the sand pack during run 2-D, taken along the horizontal and vertical mid-planes respectively.
Figure 8B:
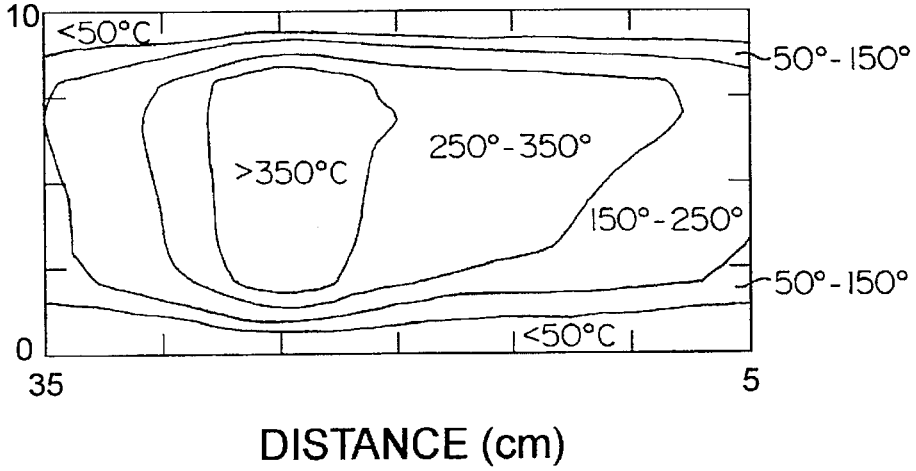

FIGS. 8*a* and 8*b* show isotherm maps developed along the horizontal mid-plane and the central vertical mid-plane, respectively, in the sand pack after 999 minutes of combustion during run 2-D, using the well configuration of FIGS. 2*a* and 2*b*. As shown, the isotherms indicate that the combustion front was substantially wider than that of Run 1 and more upright.

Figure 9A:
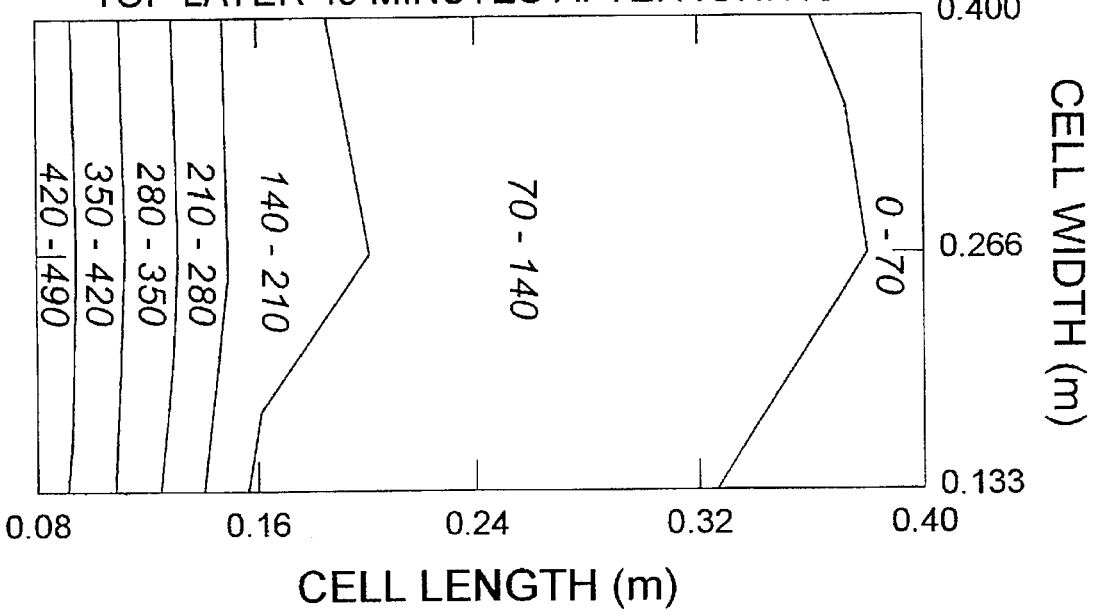
FIGS. 9*a* and 9*b* are the isotherm maps developed in the sand pack after 45 minutes of combustion during run 3-D, taken along horizontal planes close to the top and bottom of the pack, respectively.
Figure 9B:
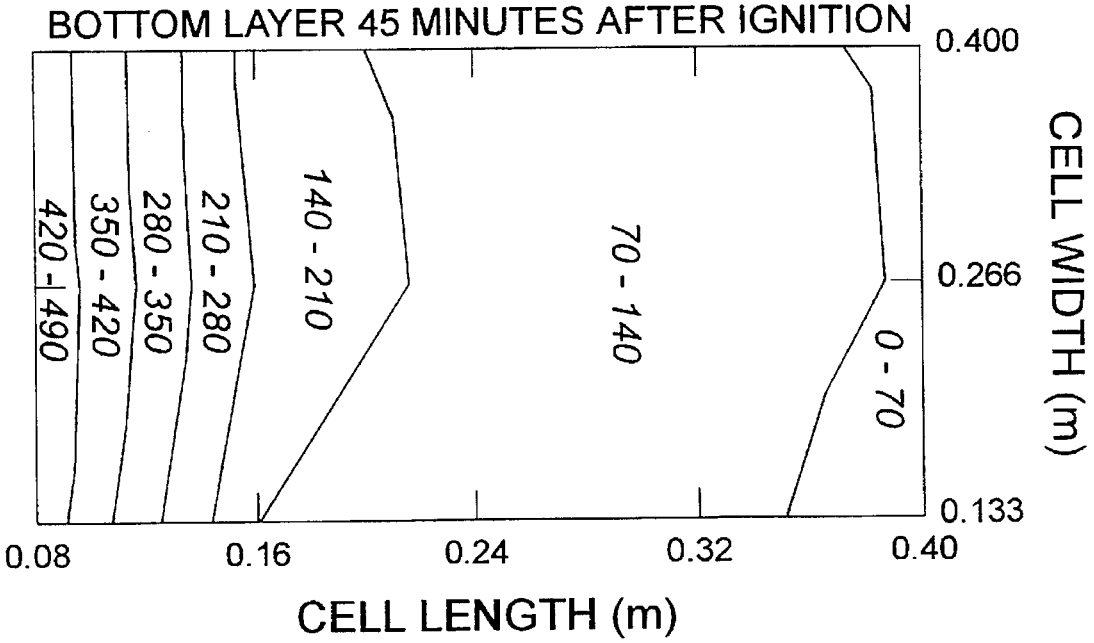
Figure 9C:
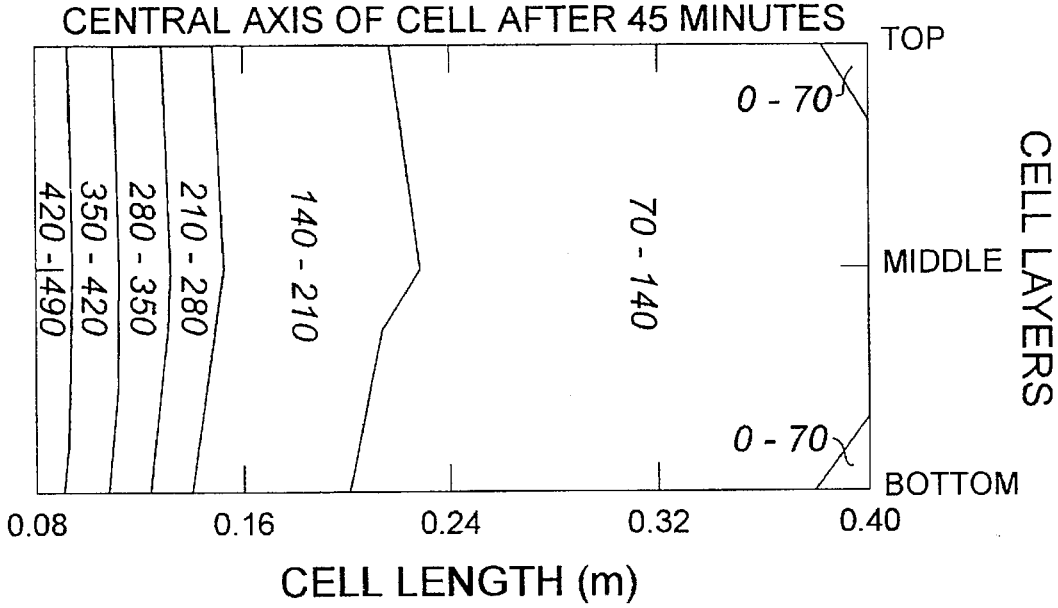
FIGS. 9*c*, 9*d*, 9*e* and 9*f* are the isotherm maps developed in the sand pack along the vertical mid-plane after 45, 240, 360 and 460 minutes of combustion, respectively, during run 3-D.
Figure 9D:
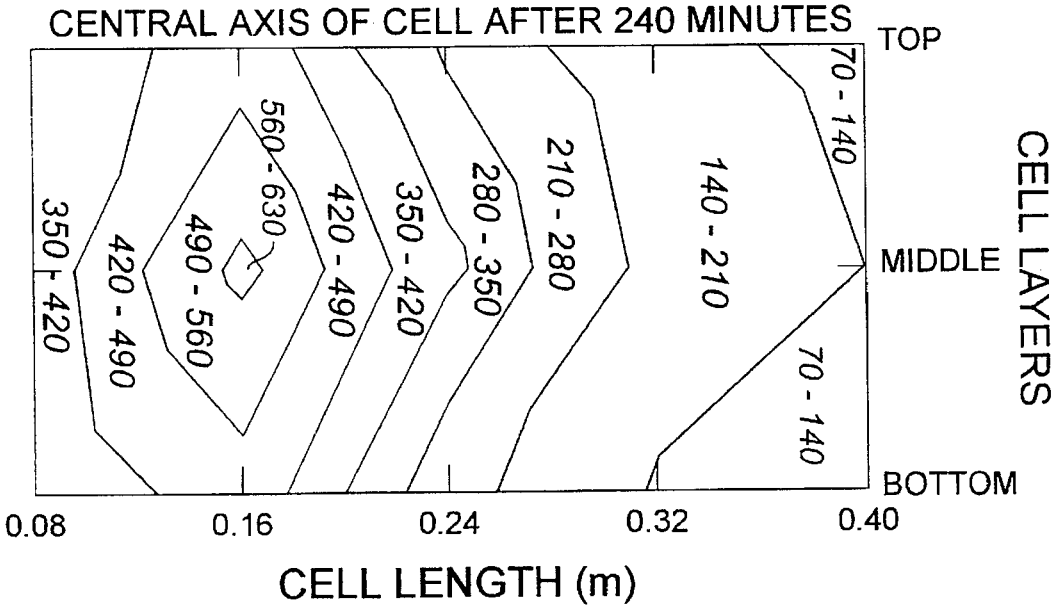
Figure 9E:
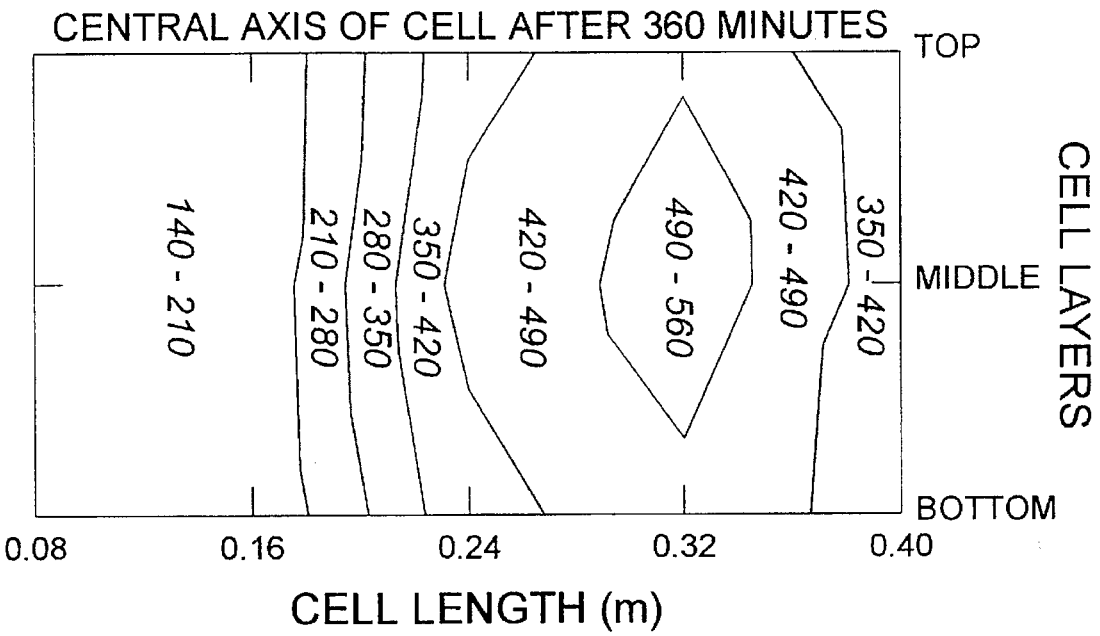
Figure 9F:
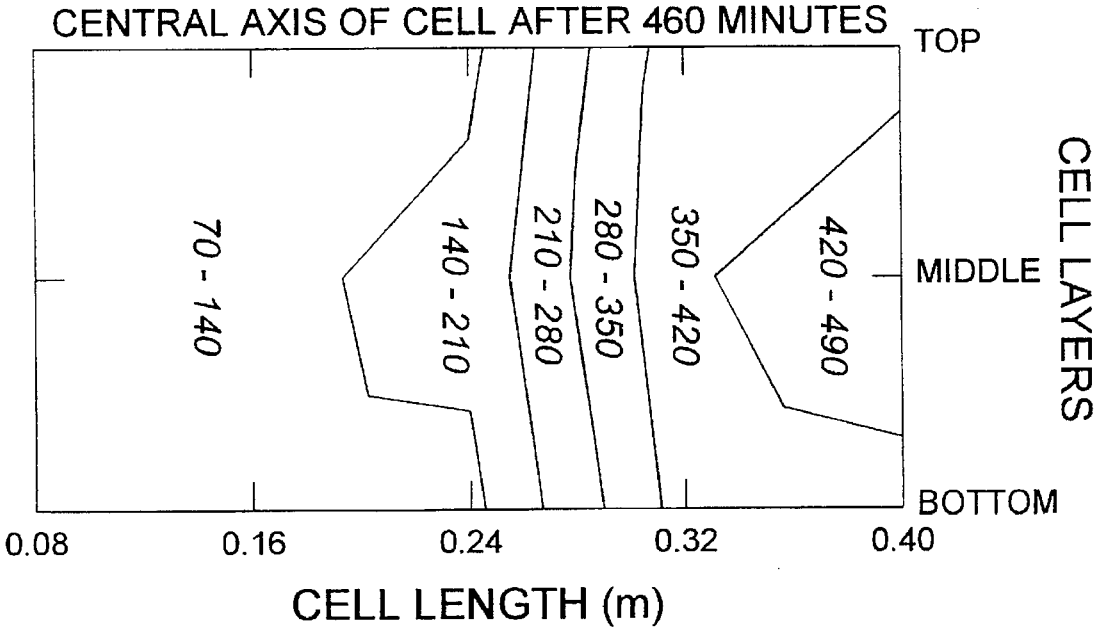
Figure 10:
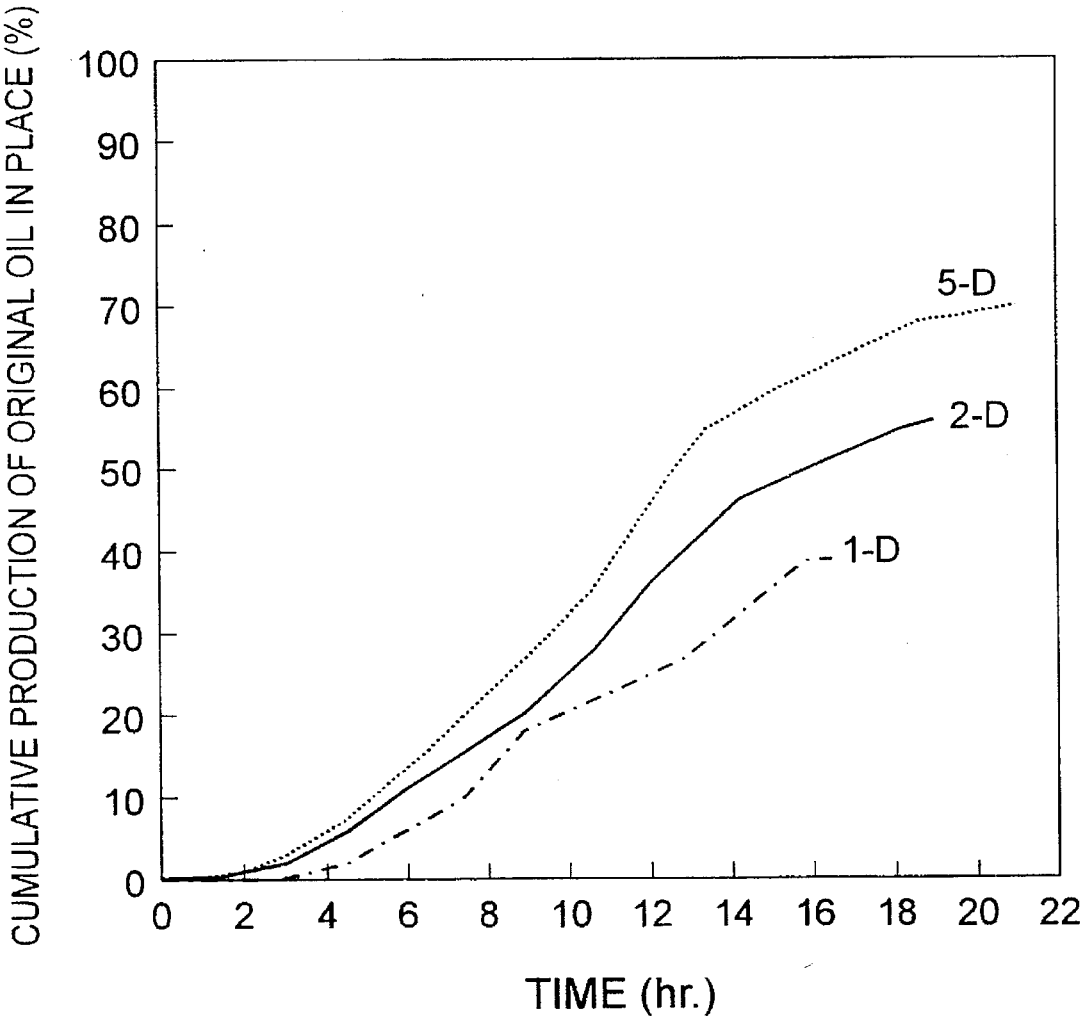
FIG. 10 is a plot showing the cumulative production of the oil in place (expressed in percent) for runs 1-D, 2-D and 5-D.

FIGS. 9*a* and 9*b* show isotherm maps developed along horizontal planes at the top and bottom of the sand pack after 45 minutes of combustion during Run 3-D, using the well configuration of FIG. 3. FIGS. 9*c*, 9*d*, 9*e* and 9*f* show isotherm maps developed along the central vertical plane of the sand pack after 45, 240, 360 and 460 minutes respectively. The isotherms demonstrate that the combustion front generated by the row of injection wells extended laterally, remained generally linear and was generally upright throughout the test. Stated otherwise, the lateral and vertical sweep was much improved relative to that of Run 1-D. This run 3-D demonstrated the preferred form of the invention.

Figure 11:
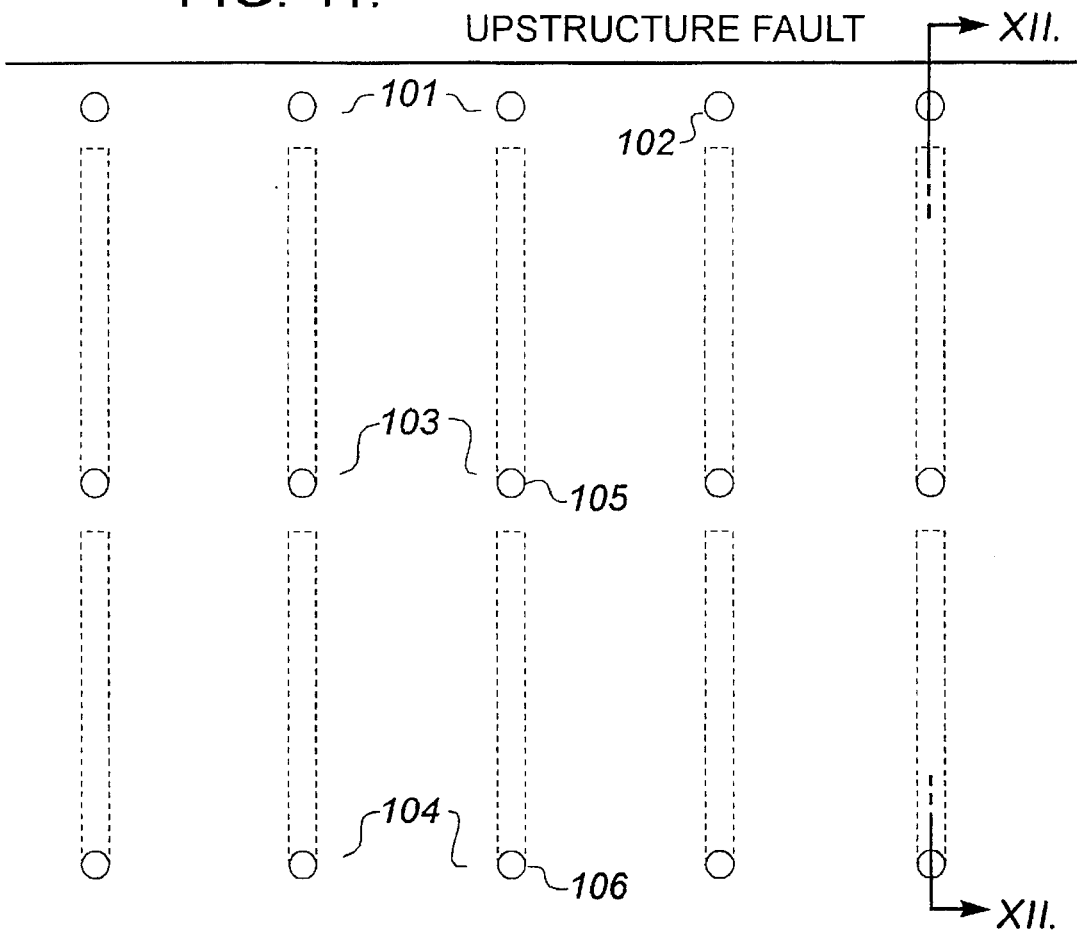
FIG. 11 is a plan view showing a preferred field embodiment of the well layout.
Figure 12:
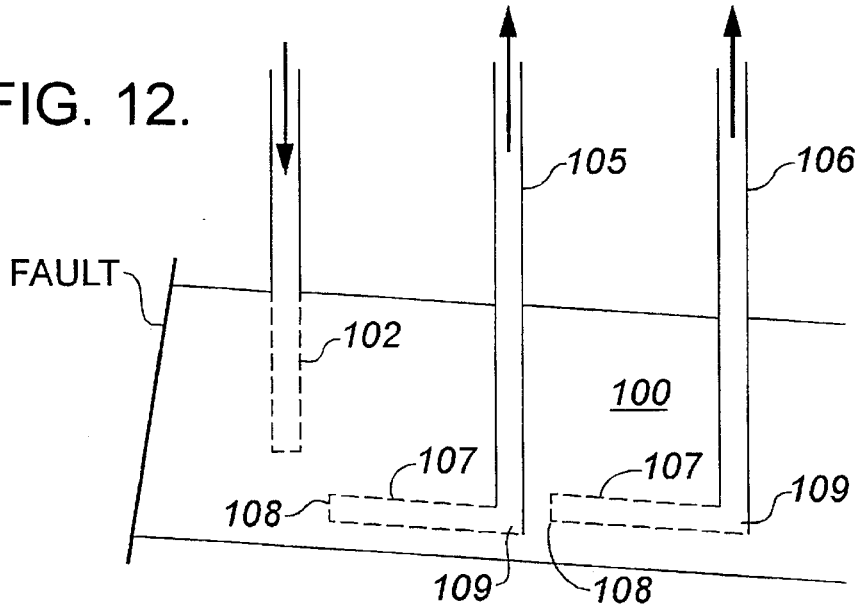
FIG. 12 is a side cross-section of the well arrangement of FIG. 11.
Figure 13:
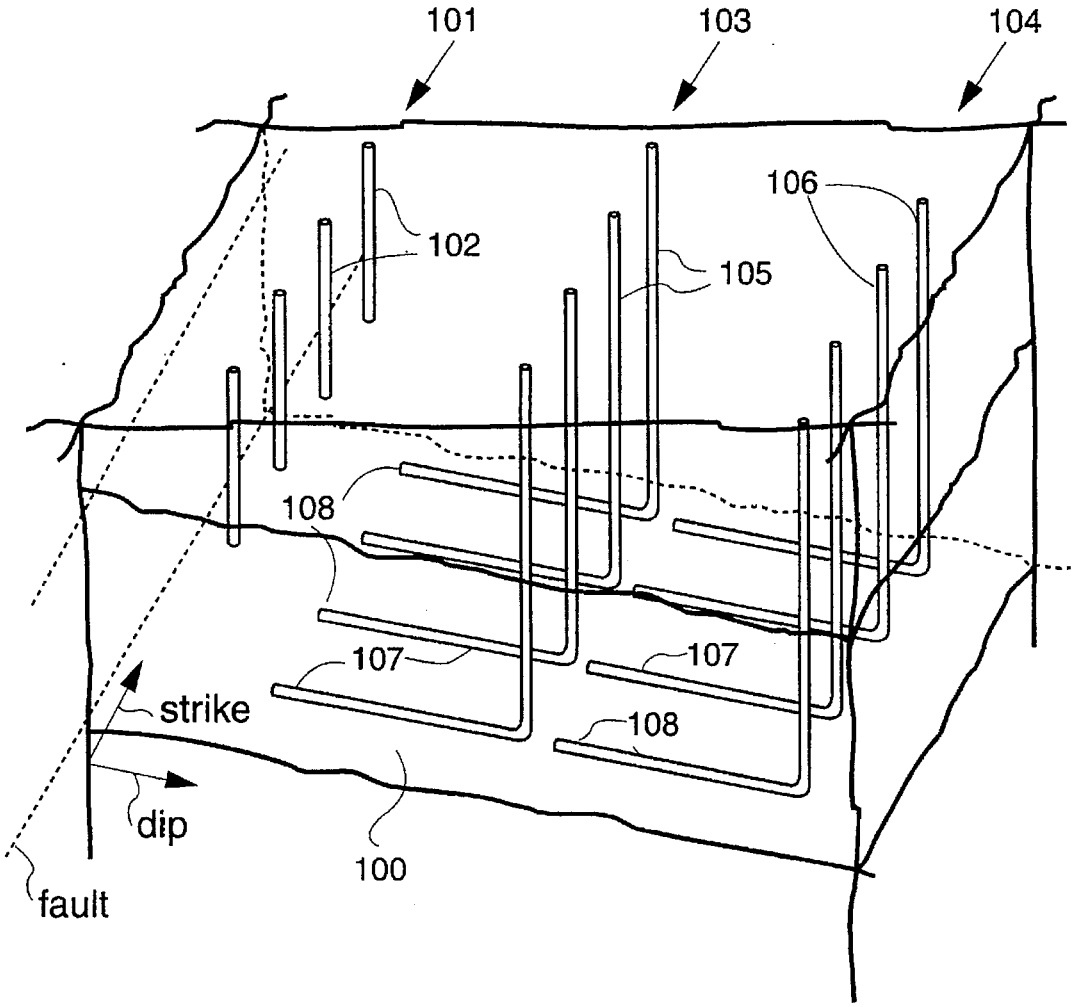
FIG. 13 is a perspective view of the reservoir in the injection well and production well layout.

In the preferred field embodiment of the invention, illustrated in FIGS. 11 and 12 and 13, a reservoir 100 is characterized by a downward dip and lateral strike. A row 101 of vertical air injection wells 102 is completed high in the reservoir 100 along the strike. At least two rows 103, 104 of production wells 105, 106, having generally horizontal legs 107, are completed low in the reservoir and down dip from the injection wells, with their toes 108 closest to the injection wells 102. The toes 108 of the row 103 of production wells 105 are spaced down dip from a vertical projection of the injection wells 102. The second row 104 of production wells 106 is spaced down dip from the first row 103. Generally, the distance between wells, within a row, is considerably lower than the distance between adjacent rows.

Figure 14C:
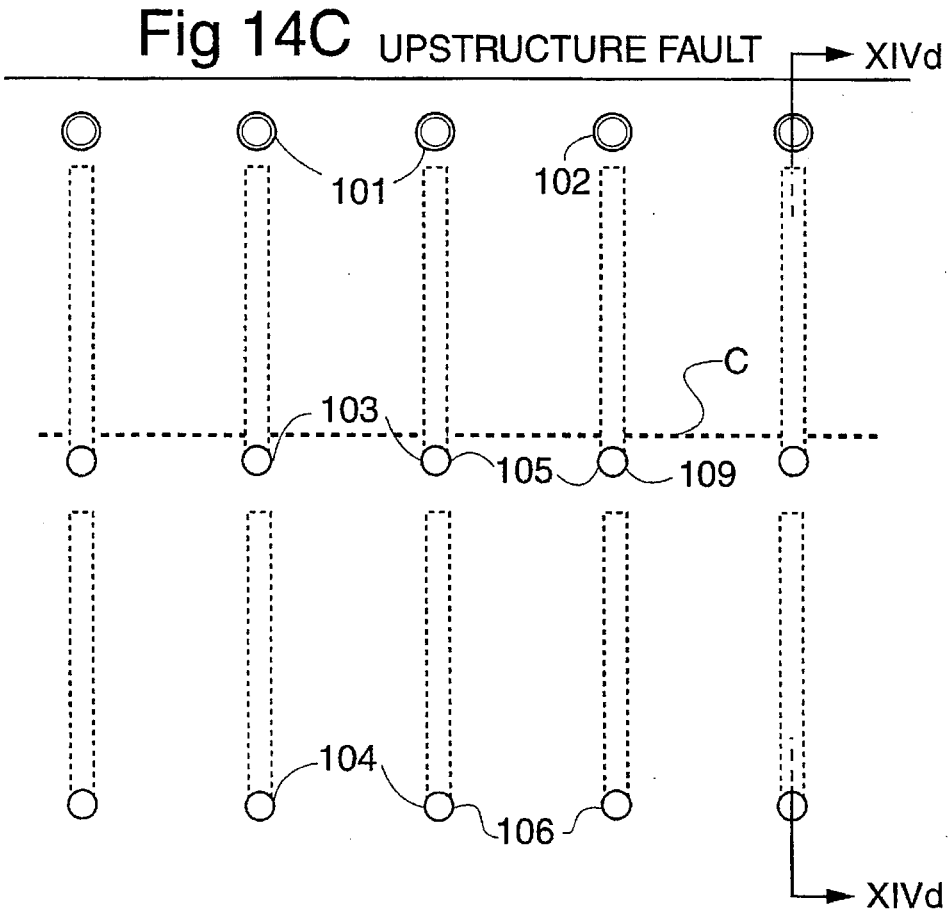
Figure 14D:
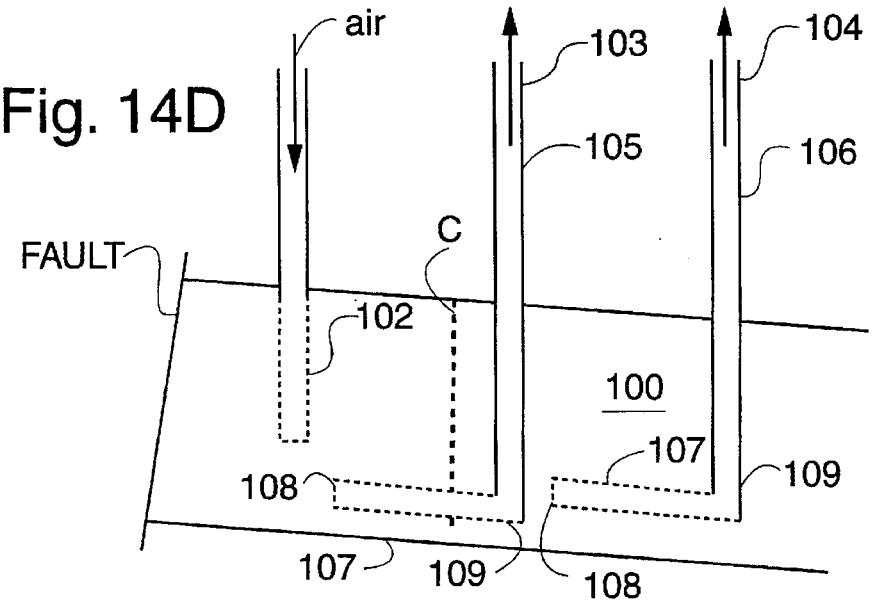
Figure 14E:
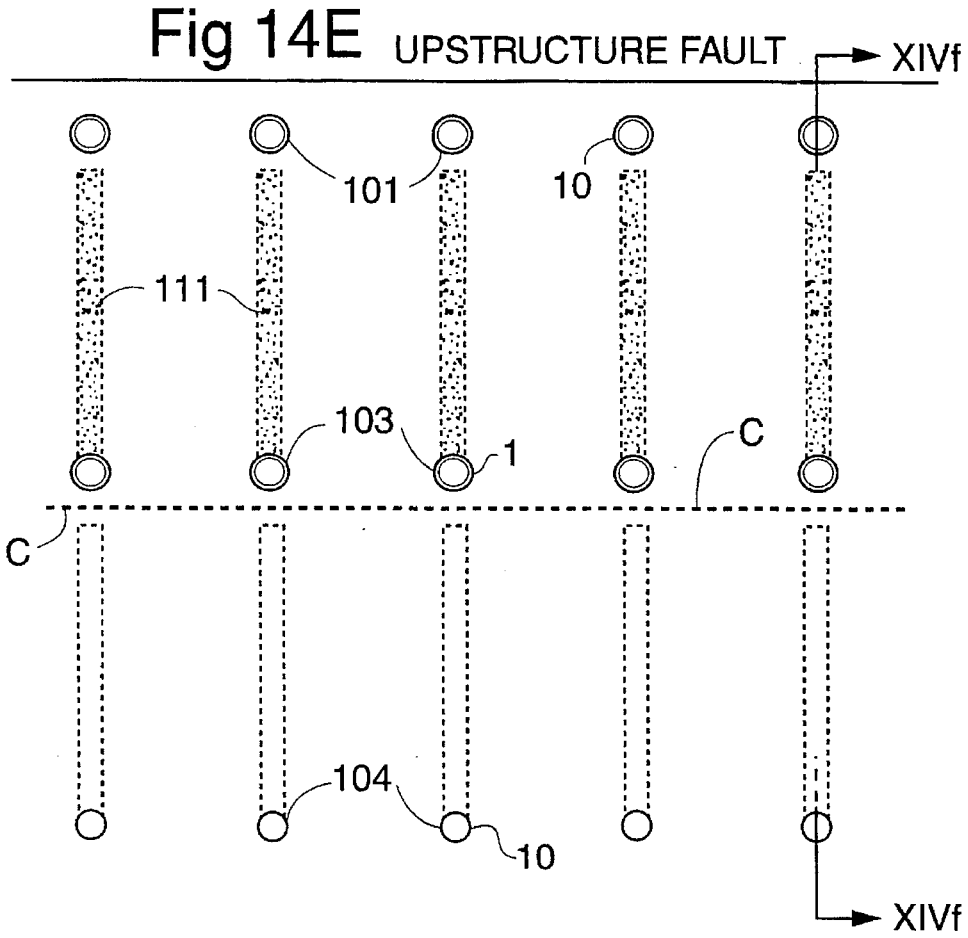
Figure 14F:
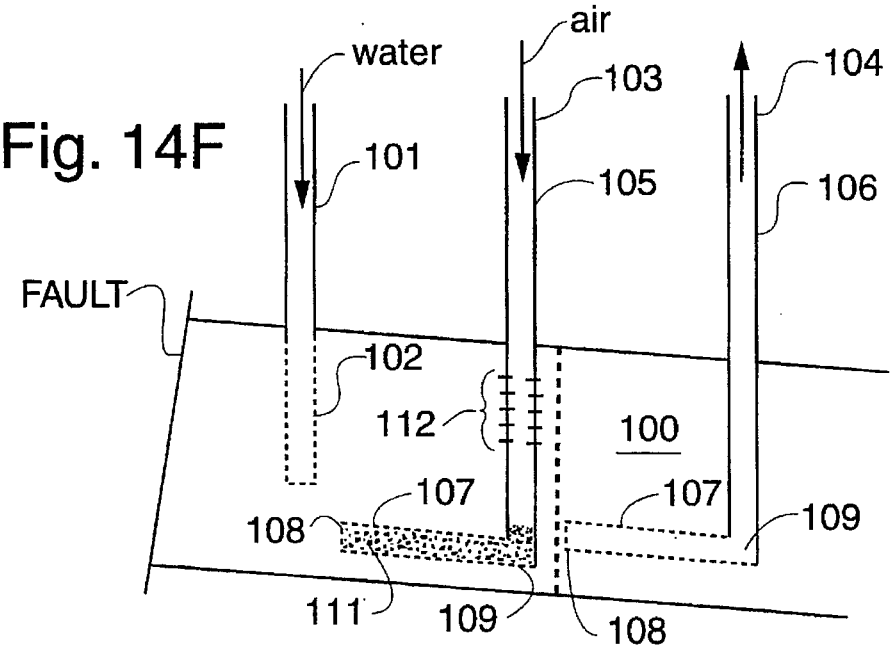

The phases of the process are set forth in FIGS. 14*a*–14*f* and are described as follows. In the first phase of the process (FIG. 14*a*), a generally linear combustion front C is generated in the reservoir 100 by injecting air through every second well 110 of the injection wells 102. Preferably a generally linear lateral combustion front is developed by initiating combustion at every second well 110 and advancing these fronts laterally until the other unused wells 102 are intercepted by the combustion front C and by keeping the horizontal production wells 105, 106 closed. Then, air is injected through all the wells 102 (FIG. 14*b*) in order to link these separate fronts to form a single front C. The front C is then propagated down dip (FIGS. 14*c*, 14*d*) toward the heel 109 of the first row 103 of production wells 105. The horizontal legs 107 of the production wells 105 are generally perpendicular to the front C. The production wells 105 are open during this step, to create a low pressure sink to induce the front to advance along their horizontal legs 107 and to provide an outlet for the heated oil. When the front C approaches the heel 109 of each production well 105, the well is closed in. The horizontal legs 107 of the closed-in wells 105 are then filled with cement 111 (FIG. 14*e*). The wells 105 are then perforated 112 high in the reservoir 100 (FIG. 14*f*) and converted to air injection, thereby continuing the propagation of a combustion front toward the second row 104 of production wells 106. Preferably, the first row 101 of injection wells is converted to water injection, for scavenging heat in the burnt out zone and bringing it ahead of the combustion zone. This process is repeated as the front progresses through the various rows of production wells.

By the practise of this process, a guided combustion front is caused to move through the reservoir with good volumetric sweep efficiency.

The embodiments of the invention in which an exclusive property or privilege is claimed are defined as follows:

1. A process for reducing the viscosity of oil and recovering it from an underground oil-containing reservoir, comprising:

providing an injection well, completed relatively high in the reservoir, for injecting a gaseous fluid into the reservoir to form an advancing, laterally extending displacement front operative to reduce the viscosity of reservoir oil;

providing at least one open production well having a horizontal leg completed relatively low in the reservoir and positioned substantially perpendicular to and in the path of the advancing displacement front;

injecting the fluid through the injection well and advancing the displacement front along the leg; and producing the production well to recover reduced-viscosity oil from the reservoir.

2. An in-situ combustion process for recovering oil from an underground oil-containing reservoir, comprising:

providing a generally linear air injection source completed relatively high in the reservoir;

providing at least one open production well comprising a horizontal leg having a toe and heel and being completed relatively low in the reservoir and positioned generally perpendicularly to the injection source so as to lie in the path of a combustion front established by the source;

injecting air through the injection source and initiating and propagating a combustion front, extending laterally of the production well horizontal leg, so that it advances toward and along the leg; and producing the production well to recover heated oil from the reservoir.

3. The process as set forth in claim 2 wherein:

the air injection source comprises a generally linear array of vertical injection wells and the toe of the horizontal leg is adjacent to but offset from the injection wells.

4. The process as set forth in claim 2 or 3 wherein:

the reservoir extends downwardly at an angle to have dip and strike;

the injection source extends generally along the strike and the horizontal leg of the production well extends along the dip.

5. The process as set forth in claim 3 wherein:

the reservoir extends downwardly at an angle to have dip and strike;

a plurality of production wells as aforesaid are provided, said production wells being arrayed in at least two spaced apart rows parallel with the array of injection wells, which are located at the uppermost part of the oil reservoir; and the rows of injection wells and production wells extend along the strike and the horizontal legs of the production wells extend along the dip.

6. The process as set forth in claim 5 comprising:

closing each production well in the first row as the combustion front approaches the heel of its horizontal leg;

filling the horizontal legs of the closed production wells in the first row with cement, re-completing the wells high in the reservoir and converting them to air injection wells; and initiating air injection through the converted wells to advance a combustion front toward the second row of production wells and along their horizontal legs.

7. The process as set forth in claim 6 comprising:

injecting water through the array of original air injection wells in the course of injecting air through the converted wells.

* * * * *

Disclaimer 5,626,191—Malcolm Greaves, Avon, United Kingdom; Alexandru T. Turta, Calgary, Canada. OILFIELD IN-SITU COMBUSTION PROCESS. Disclaimer filed February 2, 2002, by assignee, Alberta Research Council Inc.

Hereby enters this disclaimer to claim 1.

*(Official Gazette, March 26, 2002.)*